US008789302B1

(12) United States Patent
Pietrzyk

(10) Patent No.: US 8,789,302 B1
(45) Date of Patent: Jul. 29, 2014

(54) MAGAZINE GUIDE ASSEMBLY WITH DUAL LATCHING SYSTEM

(71) Applicant: O.F. Mossberg & Sons, Inc., North Haven, CT (US)

(72) Inventor: Slawomir Pietrzyk, Meriden, CT (US)

(73) Assignee: O.F. Mossberg & Sons, Inc., North Haven, CT (US)

( * ) Notice: Subject to any disclaimer, the term of this patent is extended or adjusted under 35 U.S.C. 154(b) by 0 days.

(21) Appl. No.: 14/075,185

(22) Filed: Nov. 8, 2013

Related U.S. Application Data

(63) Continuation-in-part of application No. 13/856,812, filed on Apr. 4, 2013, now abandoned.

(51) Int. Cl.
*F41A 9/65* (2006.01)

(52) U.S. Cl.
CPC ..... *F41A 9/65* (2013.01)
USPC ..... 42/6

(58) Field of Classification Search
USPC ..... 42/6, 49.01, 49.02, 50; 89/197, 128
See application file for complete search history.

(56) References Cited

U.S. PATENT DOCUMENTS 2,619,876 A 12/1952 Olson

*Primary Examiner* — Reginald Tillman, Jr.
(74) *Attorney, Agent, or Firm* — Donald S. Holland, Esq.; Holland & Bonzagni, P.C.

(57) ABSTRACT

Applicant has disclosed a Magazine Guide Assembly with Dual Latching System for bolt-action rifles for guiding, latching and unlatching differently shaped firearm magazines for other rifles. In other words, the assembly is an adapter for bolt-action rifles. In the preferred embodiment, Applicant's invention comprises: (a) a magazine guide housing, attachable to a receiver of a bolt-action rifle, for guiding and latching differently shaped magazines designed for AR-10 and M-14 style semi-automatic rifles; (b) the magazine guide housing has different first and second latches, wherein: (i) the latches are respectively hinged on first and second pins, attached to the housing, and activated by a single torsion spring; and (ii) the first latch is adapted to latch onto a AR-10 style magazine designed for an AR-10 style semi-automatic rifle, while the second latch is adapted to latch onto a differently shaped M-14 style magazine designed for an M-14 style semi-automatic rifle.

8 Claims, 6 Drawing Sheets

MAGAZINE GUIDE ASSEMBLY WITH DUAL LATCHING SYSTEM

RELATED APPLICATION

This is a continuation-in-part of U.S. patent application Ser. No. 13/856,812, filed Apr. 4, 2013, which was based upon U.S. Provisional Patent Application Ser. No. 61/686,733, filed Apr. 11, 2012. Applicant claims priority from those two prior applications. Applicant also hereby incorporates by reference those two prior applications in their entirety.

FIELD OF INVENTION

This invention relates generally to firearms. More specifically, it relates to attaching magazines for bolt-action rifles.

BACKGROUND OF INVENTION

Cartridges (also known as rounds) for firearms are elongated. A typical cartridge includes a shell casing, made of brass, which is filled with an explosive propellant. At its rear or closed end, the casing has a rim or flange containing a primer. Next to the rim is an extractor groove, an annular groove machined into the casing which provides a grip for the gun's extractor to pull the fired or unfired casing from the chamber of the firearm. The front and opposite end of the casing is open. A bullet, projectile, or head, usually of lead (optionally jacketed) is partially inserted into the open or front end of the case by crimping the casing onto the bullet.

Some rifles have internally fixed magazines for feeding cartridges into a chamber. For example, U.S. Pat. No. 2,619,876 to Olson discloses a "magazine rifle" with an internal magazine.

The AR-15 was first built by ArmaLite, Inc. as a selective fire rifle for the United States armed forces. Because of financial problems, ArmaLite sold the AR-15 design to Colt. The select-fire AR-15 entered the U.S. military system as the M-16 rifle. Colt then marketed the Colt® AR-15 as a semi-automatic version of the M-16 rifle for civilian sales in 1963. Although the name "AR-15" and "AR-10" are registered trademarks of Colt and ArmaLite, other semi-automatic firearms are independently made, modified and sold under various names by multiple manufacturers. Most are referred to interchangeably as "AR" or "AR" style rifles (e.g., AR-10 and AR-14).

Other rifles, such as the AR-10 and M-14 styles, use detachable magazines instead to feed cartridges. Detachable magazines usually are elongated containers, generally rectangular in cross-section, which are attached to the underside of the rifle (i.e., inside a well opening of the receiver). Such magazines are commonly made of aluminum alloys, plastic, steel, or a combination.

Detachable magazines are usually closed on the sides and open on an upwardly facing top. The open top has a rectangular opening and includes two round-retaining members, known as feed lips, which project into or partly close the opening. An internal spring urges a follower or lifter (i.e., a shaped piece of plastic or metal) toward the open side. The spring-loaded follower in turn urges the rounds as a group up against the lips. The lips act as a stop for the rounds so that they are not expelled from the magazine.

Rounds are stacked or oriented in the detachable magazine such that the longitudinal axes of the rounds are substantially parallel and perpendicular to the direction of travel of the spring and follower. Adjoining rounds are oriented side-by-side and in the same direction, i.e., the bullets of adjacent rounds are next to each other, as are the cases.

The rounds are usually stacked in the magazine, either in a single straight column or in a staggered (zigzag) column (also called double-stacked or high-capacity) fashion. The double-stacked magazines, being wider, have a higher round capacity compared to single-column magazines of the same overall length.

Typically, firearm magazines are slid upwardly into well openings of receivers and removably latched in place. Some well openings include integral magazine guide assemblies. Those assemblies extend downwardly form the well openings to guide and lock the magazine.

Different styles of semi-automatic rifles (e.g., AR-10 and M-14) use different style magazines with different latches. For example, an AR-10 style magazine typically cannot be used with an M-14 style rifle.

Bolt-action rifles typically use magazines designed for bolt-action rifles. Such rifles do not have the hardware, within their well openings, to latch onto either AR-10 style or AR-15 style magazines.

Accordingly it is a primary object of the present invention to provide an improved magazine guide assembly, for bolt-action rifles, which can accommodate two different styles of magazines.

It is a more specific object to provide a magazine guide assembly, for bolt-action rifles, for latching and unlatching magazine styles for two styles of semi-automatic (e.g., AR-10 or M-14 style) rifles.

It is another object to provide an improved magazine guide assembly, commensurate with the above-listed objects, which has few moving parts and is durable to use.

SUMMARY OF INVENTION

Applicant has disclosed a new "Magazine Guide Assembly with Dual Latching System." It is an adapter which can be used, in the well opening of a bolt-action rifle, for latching and unlatching either an AR-10 or M-14 style magazine. In other words, the Magazine Guide Assembly is dual magazine compatible.

BRIEF DESCRIPTION OF DRAWINGS

The above and other objects and advantages of the present invention will become more readily apparent upon reading the following description and drawings in which.

DETAILED DESCRIPTION OF PREFERRED EMBODIMENT(S)

Figure 1:
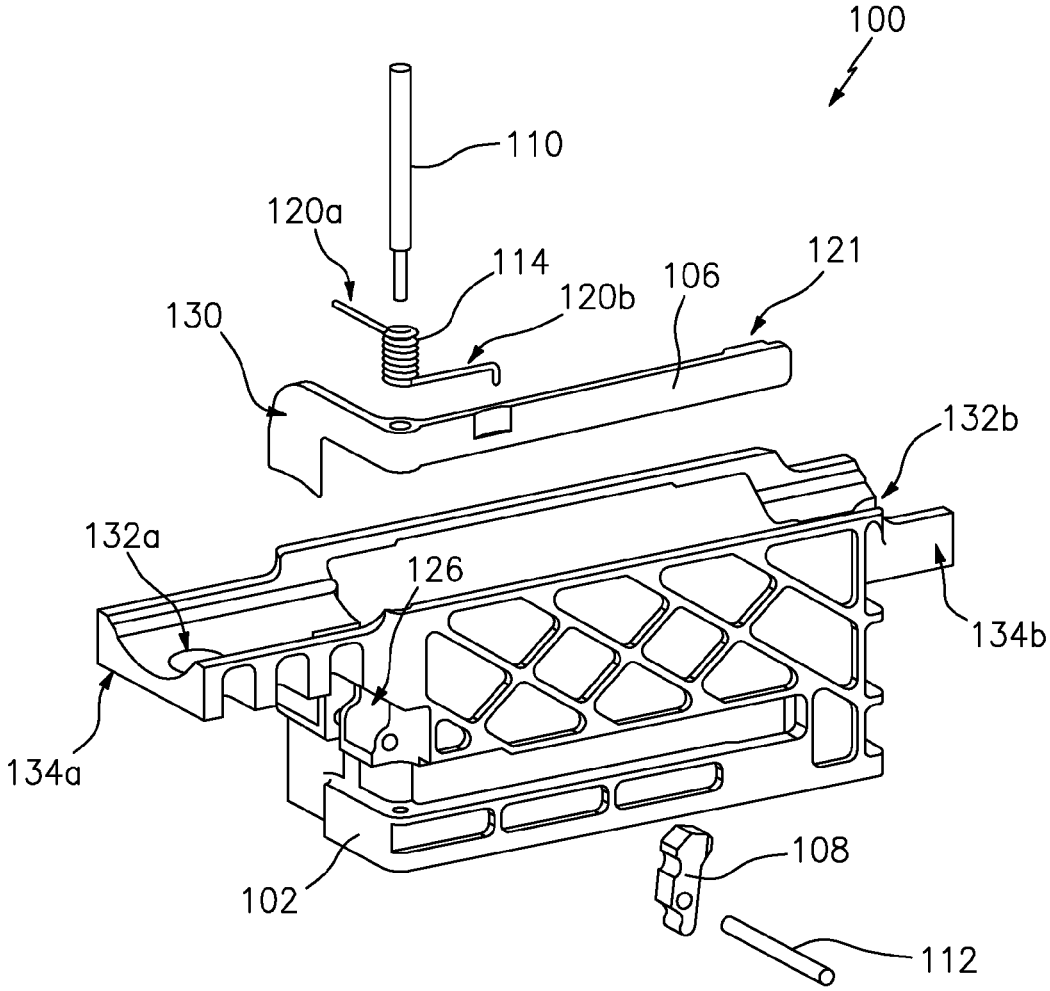
FIG. 1 is an exploded view of Applicant's preferred embodiment of a Magazine Guide Assembly with Dual Latching System ("Magazine Guide Assembly") designed to be removably attached within a well opening of a bolt-action rifle.

Referring to the drawings in detail, Applicant has disclosed a new "Magazine Guide Assembly with Dual Latching System" ("Magazine Guide Assembly"). The illustrated embodiment 100 can be used in a well opening of a bolt-action rifle for latching and unlatching magazines for either AR-10 style or M-14 style magazines. In other words, the Magazine Guide Assembly is dual magazine compatible.

As used herein, the term "AR-10 style magazine" refers to magazines for both AR-10® and AR-10 style semi-automatic rifles. Similarly, the term "M-14 style magazine" refers to magazines for both M-14 and M-14 style semi-automatic rifles.

In the preferred embodiment 100, the invention comprises: a magazine guide housing 102 (attachable to a firearm receiver 104) with two individual latches 106, 108, which are hinged on two individual pins 110, 112 and activated by a single torsion spring 114. Latch 106 accommodates an AR-10 style magazine 116, while latch 108 accommodates an M-14 style magazine 118. Two arms 120*a*, 120*b* on the torsion spring 114 constantly apply force on the "AR-10" and "M-14" latches 106, 108 to effectively maintain the latches in closed positions.

As typical with prior assemblies, the magazines (e.g., 116, 118) are to be inserted by vertical upward motion through the bottom opening of the Magazine Guide Assembly.

Figure 2:
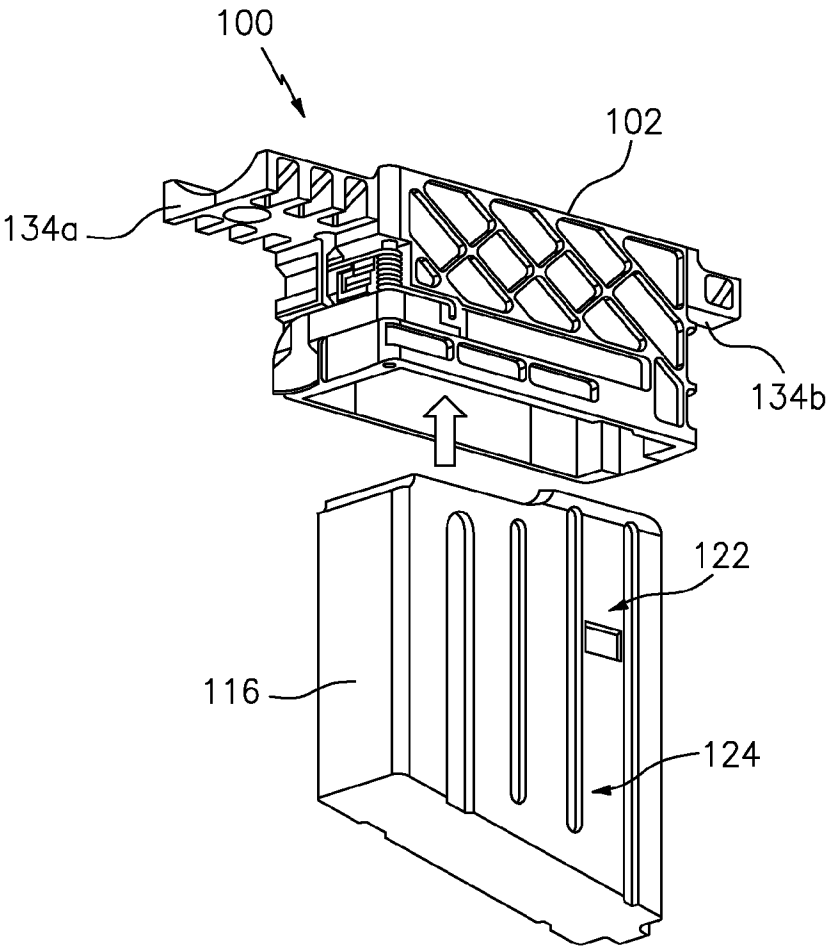
Figure 4:
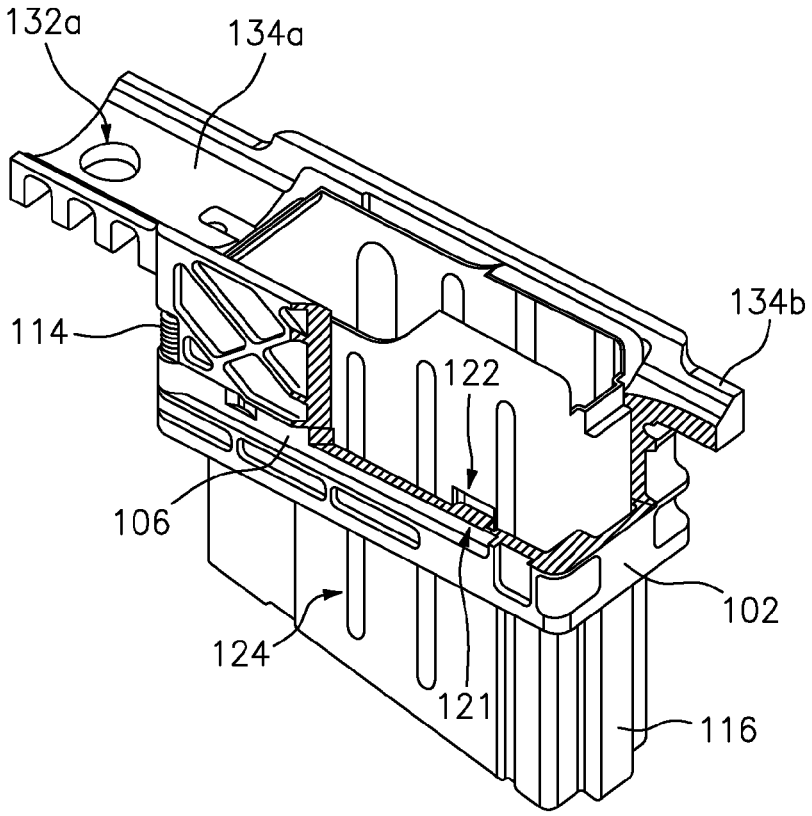
FIG. 4 is a rear perspective view, with portions cutaway, of Applicant's preferred Magazine Guide Assembly with an AR-10 style magazine inserted.
Figure 5:
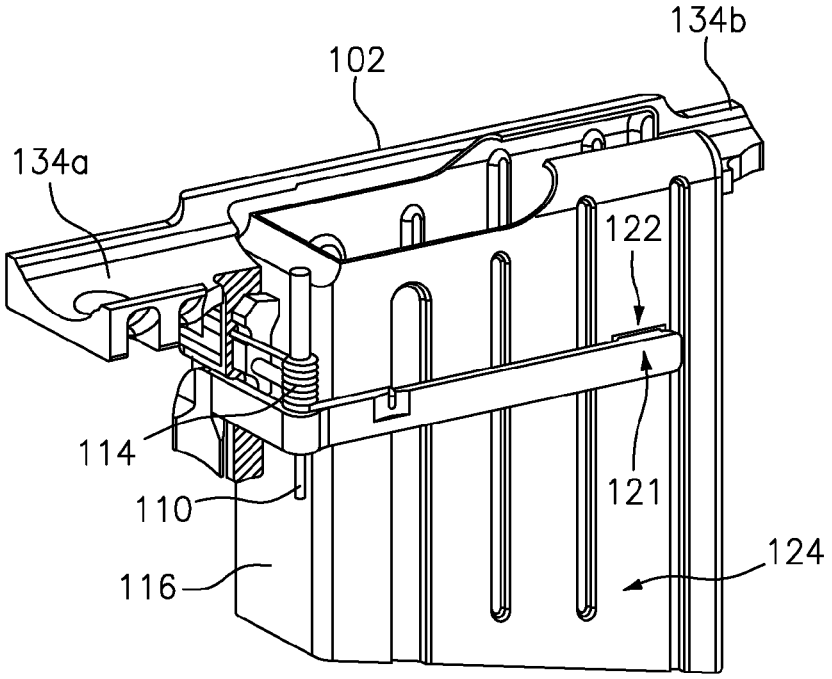
FIG. 5 is a front perspective view, with portions cutaway, of Applicant's preferred Magazine Guide Assembly with an AR-10 style magazine inserted.

As shown in FIGS. 2, 4 and 5, in the event of an AR-10 style magazine 116 being fully inserted into the Magazine Guide Assembly 100, the AR-10 latch 106 will pivot around its pin 110; and a nib or protrusion 121 (of the latch) will fall into a window 122 on a side wall 124 of the AR-10 magazine 116 thus locking it in place.

Figure 3:
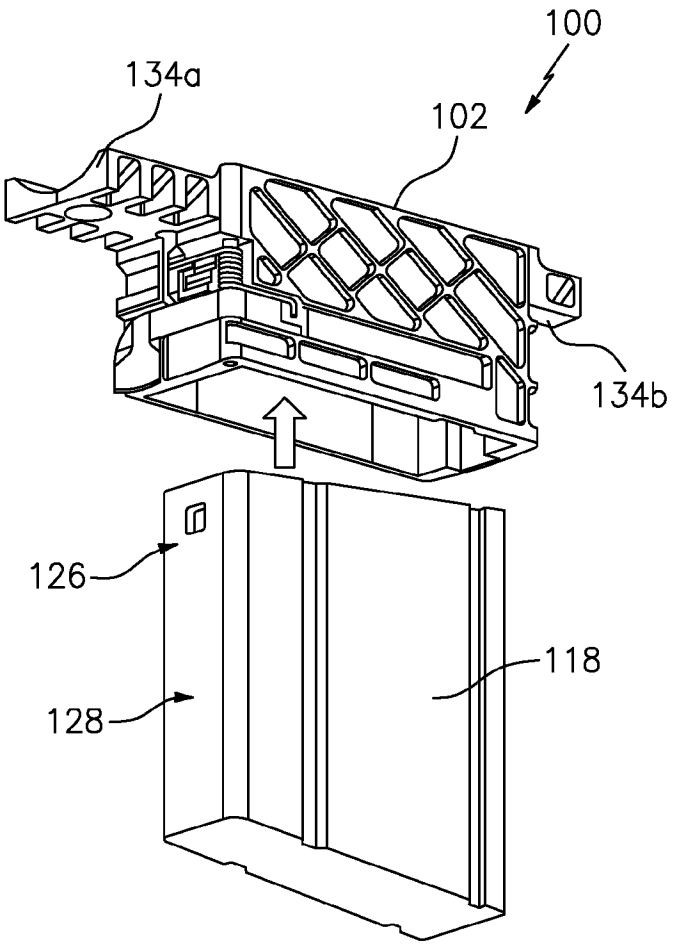
FIGS. 2 and 3 depict a side-by-side comparison of Applicant's preferred Magazine Guide Assembly, here accepting AR-10 and M-14 style magazines.
Figure 6:
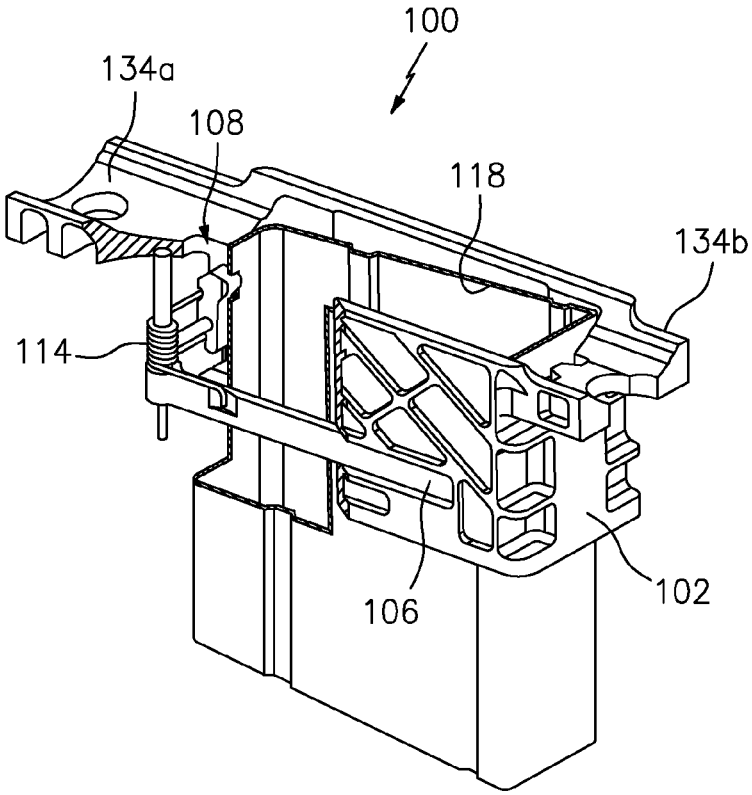
FIG. 6 is a rear perspective view, with portions cutaway, of Applicant's preferred Magazine Guide Assembly with an M-14 style magazine inserted.
Figure 7:
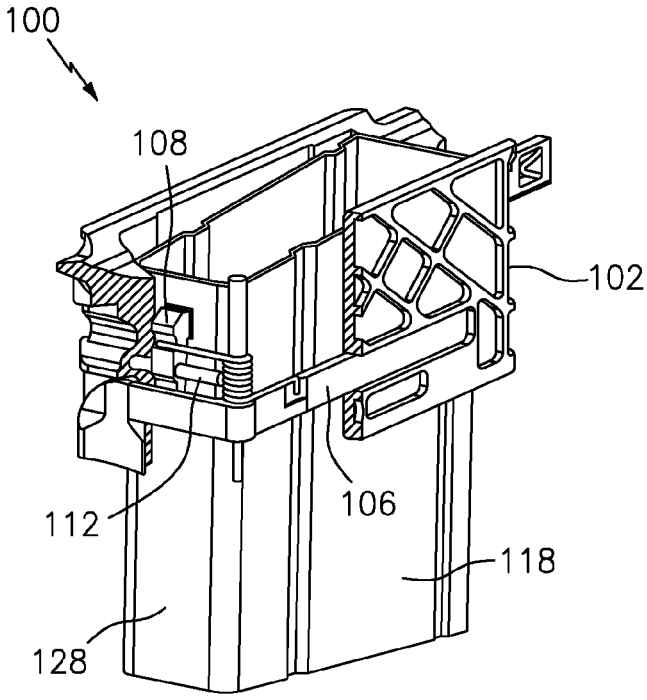
FIG. 7 is a front perspective view, with portions cutaway, of Applicant's preferred Magazine Guide Assembly with an M-14 style magazine inserted.
Figure 9:
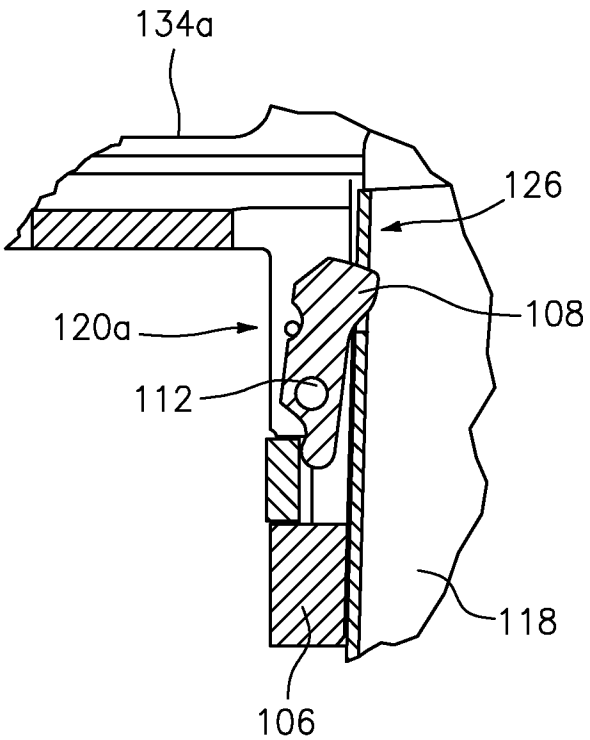
FIG. 9 shows the M-14 latch of Applicant's preferred Magazine Guide Assembly engaged with the M-14 magazine.
Figure 8:
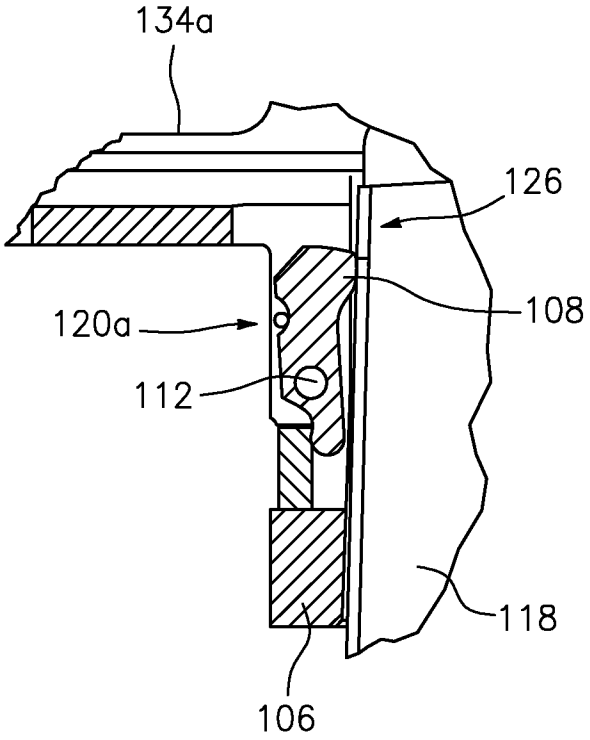
FIG. 8 shows an M-14 latch of Applicant's preferred Magazine Guide Assembly disengaged from an M-14 magazine.

As shown in FIGS. 3, 6 and 7, in the event of an M-14 style magazine 118 being fully inserted into the Magazine Guide Assembly 100, the M-14 latch 108 will pivot around its pin 112 and fall into a window 126 (see also FIG. 1) on a front wall 128 of the M-14 magazine 118, thus locking it in place.

The AR-10 latch 106 also serves the purpose of a disengaging lever for both styles of magazines 116, 118. The concave AR-10 latch 106 has a built-in finger 130 (at one end of the latch) to which pressure force shall be applied for disengaging action. Applying pressure to the finger 130 will cause the AR-10 latch 106 to pivot around its pin 110 to disengage its nib 121 from the AR-10 magazine 116. The pivoting AR-10 latch 106 is simultaneously pushing upon the M-14 latch 108; that causes the M-14 latch to pivot around its own pin 112 and to disengage from the M-14 magazine 118.

Figure 10:
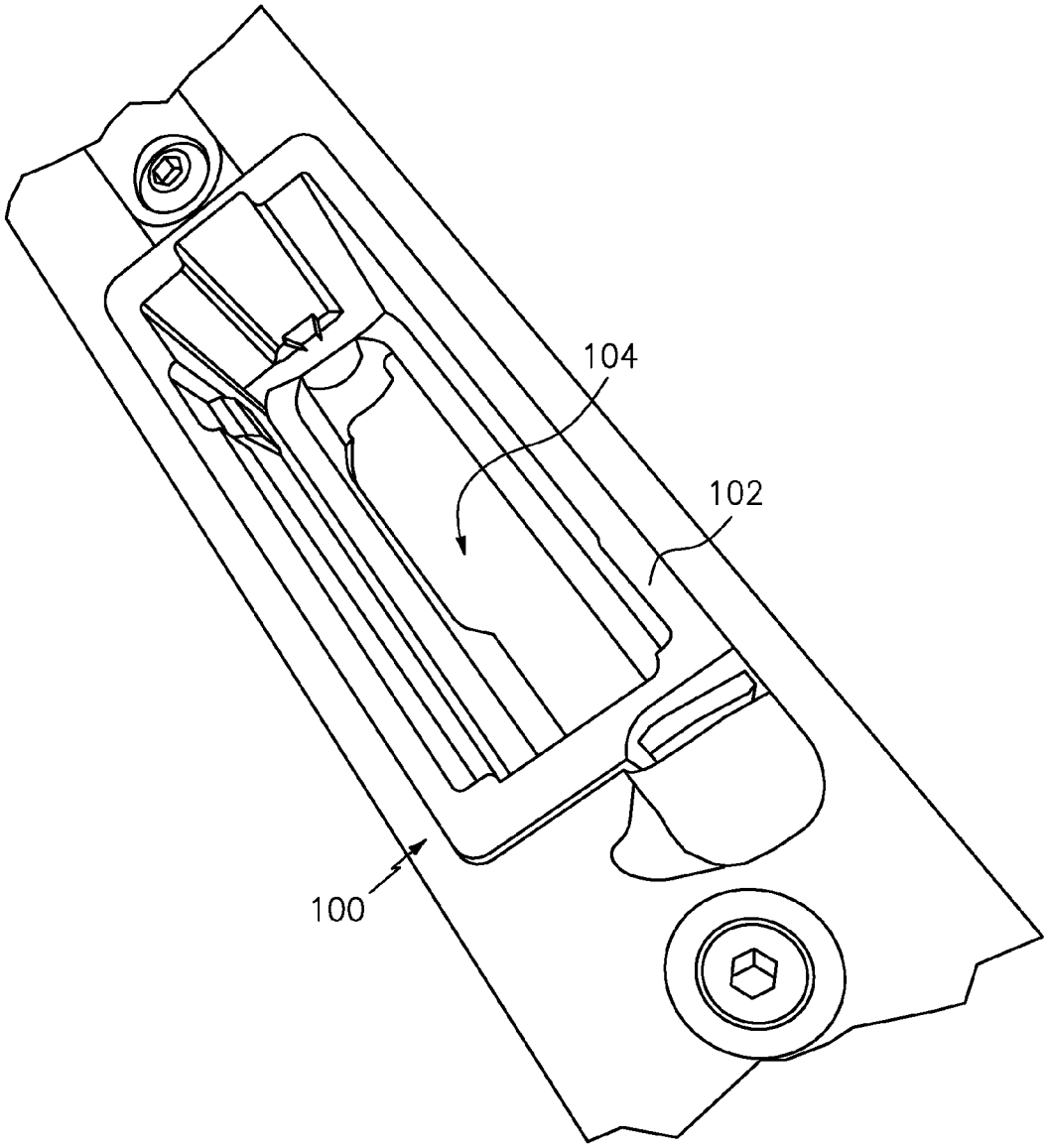
FIG. 10 shows Applicant's preferred Magazine Guide Assembly attached to a receiver of a bolt-action rifle, with portions broken away.

The illustrated Magazine Guide Assembly 100 has holes 132*a*, 132*b* in wings 134*a*, 134*b* (see FIG. 1) for securing or attaching the guide inside the well opening of a receiver (e.g., 104—see FIG. 10) of a bolt-action rifle. The preferred Magazine Guide Assembly 100 is shown flush with the bottom of the well opening. An alternate embodiment of the guide could extend below.

Applicant's invention can also be thought of, in broad terms, as an apparatus comprising: a single magazine guide housing, attached to a receiver of a bolt-action rifle, having means for guiding and latching differently shaped magazines, at separate times, designed for AR-10 style and M-14 style semi-automatic rifles. In the preferred embodiment, that means comprises: the individual ("first" and "second") latches 106, 108, hinged on two individual pins 110, 112, and activated by a single torsion spring 114; wherein latch 106 is designed to latch an AR-10 style magazine 116, while latch 108 is designed to latch an M-14 style magazine 118; and wherein two arms 120*a*, 120*b* on the torsion spring 114 constantly apply force on the latches 106, 108 to effectively maintain the latches in closed (latched) positions.

It should be understood by those skilled in the art that obvious structural modifications can be made without departing from the spirit of the invention. For example, the Magazine Guide Assembly concept could be used with magazines for two other styles of rifle. Accordingly, reference should be made primarily to the accompanying claims rather than the foregoing description to determine the scope of the invention.

Having thus described the invention, I claim:

1. An apparatus comprising:

a. a magazine guide housing, attachable to a receiver of a bolt-action rifle, for guiding and latching differently shaped magazines designed for AR-10 and M-14 semi-automatic rifles;

b. the magazine guide housing has different first and second latches, wherein:

i. the latches are respectively hinged on first and second pins, attached to the housing, and activated by a single torsion spring; and ii. the first latch is adapted to latch onto an AR-10 magazine designed for an AR-10 semi-automatic rifle, while the second latch is adapted to latch onto a differently shaped M-14 style magazine designed for an M-14 style semi-automatic rifle.

2. The apparatus of claim 1 further comprising: the first latch is adapted to pivot around the first pin, upon an AR-10 magazine being fully inserted into the magazine guide housing, and to fall into a window in a side wall of the AR-10 style magazine thereby locking the AR-10 style magazine in place.

3. The apparatus of claim 2 further comprising: the second latch is adapted to pivot around the second pin, upon an M-14 magazine being fully inserted into the magazine guide assembly, and to fall into a window on a front wall of the M-14 magazine thereby locking the M-14 style magazine in place.

4. The apparatus of claim 3 further comprising: two arms on the torsion spring apply force on the latches to bias the latches into closed positions.

5. An apparatus comprising: a single magazine guide housing, attachable to a receiver of a bolt-action rifle, having means for guiding and latching differently shaped magazines designed for AR-10 and M-14 semi-automatic rifles.

6. The apparatus of claim 5, wherein the means comprises:

a. first and second latches, hinged respectively on two individual pins, and activated by a single torsion spring;

b. wherein the first latch is designed to latch an AR-10 magazine, while the second latch is designed to latch an M-14 magazine; and c. wherein two arms on the torsion spring constantly apply force on the latches to maintain the latches in closed positions.

7. An apparatus comprising: a single magazine guide housing, attachable to a receiver of a bolt-action rifle, having means for guiding and latching, at separate times, two differently shaped magazines designed for semi-automatic rifles.

8. An apparatus comprising:

a. a magazine guide housing, designed to be attached within the well opening of a rifle, for guiding and latching, at separate times, two differently shaped detachable firearm magazines designed for rifles;

b. the magazine guide housing has different first and second latches wherein:

i. the latches are respectively hinged on separate pins, attached to the housing, and activated by a single torsion spring;

ii. the first latch is adapted to latch one of the differently shaped magazines, while the second latch is adapted to latch another of the differently shaped magazines; and iii. two arms on the torsion spring apply force on the latches to bias the latches into the closed positions.

* * * * *

UNITED STATES PATENT AND TRADEMARK OFFICE

CERTIFICATE OF CORRECTION

PATENT NO. : 8,789,302 B1
APPLICATION NO. : 14/075185
DATED : July 29, 2014
INVENTOR(S) : Slawomir Pietrzyk It is certified that error appears in the above-identified patent and that said Letters Patent is hereby corrected as shown below:

In the Claims

In Claim 2, Column 4, line 41, after "AR-10" delete "style".

In Claim 2, Column 4, line 42, after "AR-10" delete "style".

In Claim 3, Column 4, line 47, after "M-14" delete "style".

Signed and Sealed this
Twenty-first Day of October, 2014

Michelle K. Lee

Michelle K. Lee
*Deputy Director of the United States Patent and Trademark Office*